US006177785B1

(12) United States Patent
Lee

(10) Patent No.: US 6,177,785 B1
(45) Date of Patent: Jan. 23, 2001

(54) PROGRAMMABLE VOLTAGE REGULATOR CIRCUIT WITH LOW POWER CONSUMPTION FEATURE

(75) Inventor: Jae-Jum Lee, Kyunggi-do (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/408,963

(22) Filed: Sep. 29, 1999

(30) Foreign Application Priority Data

Sep. 29, 1998 (KR) ..... 98-40588

(51) Int. Cl.[7] ..... G05F 1/40
(52) U.S. Cl. ..... 323/281; 323/349
(58) Field of Search ..... 323/273, 280, 323/281, 311, 313, 315, 349, 354

(56) References Cited

U.S. PATENT DOCUMENTS

| | | | | |
|---|---|---|---|---|
| 4,622,512 | | 11/1986 | Brokaw | 323/313 |
| 4,810,948 | * | 3/1989 | Takuma | 323/280 |
| 5,229,710 | | 7/1993 | Kraus et al. | 323/313 |
| 5,453,678 | | 9/1995 | Bertolini et al. | 323/282 |
| 5,467,010 | | 11/1995 | Quarmby et al. | 323/284 |
| 5,546,042 | * | 8/1996 | Tedrow et al. | 323/281 |
| 5,559,425 | * | 9/1996 | Allman | 323/315 |
| 5,568,045 | | 10/1996 | Koazechi | 323/314 |
| 5,648,718 | | 7/1997 | Edwards | 323/274 |
| 5,672,959 | | 9/1997 | Der | 323/273 |
| 5,717,319 | | 2/1998 | Jokinen | 323/280 |
| 5,811,993 | | 9/1998 | Dennard et al. | 327/54 |
| 5,825,169 | | 10/1998 | Selander et al. | 323/315 |
| 5,834,926 | | 11/1998 | Kadanka | 323/313 |
| 5,852,359 | | 12/1998 | Callahan, Jr. et al. | 323/274 |
| 5,864,226 | | 1/1999 | Wang et al. | 323/273 |
| 5,900,772 | | 5/1999 | Somerville et al. | 327/539 |
| 5,943,635 | * | 8/1999 | Inn | 702/60 |

* cited by examiner

*Primary Examiner*—Peter S. Wong
*Assistant Examiner*—Gary L. Laxton
(74) *Attorney, Agent, or Firm*—F. Chau & Associates, LLP

(57) ABSTRACT

A voltage regulator according to the present invention includes a programmable reference generator, a programmable output adjustor, an error amplifier, and an output driver. The programmable reference generator is responsive to a first programming signal and generates a reference voltage. The programmable output adjustor is responsive to a second programming signal and generates an output adjust voltage. The error amplifier generates an error voltage corresponding to a difference between the reference voltage and the output adjust voltage. The output driver drives a regulated output voltage in response to the error voltage. A capacitor is coupled between the regulated output voltage and a ground voltage to eliminate ripple components on the regulated voltage.

28 Claims, 5 Drawing Sheets

PROGRAMMABLE VOLTAGE REGULATOR CIRCUIT WITH LOW POWER CONSUMPTION FEATURE

FIELD OF THE INVENTION

The present invention relates to an integrated circuit voltage regulator and, more particularly, to a voltage regulator circuit for generating programmable output voltage and having a low power consumption feature.

DESCRIPTION OF THE RELATED ART

A voltage regulator is a circuit for providing a constant direct current (DC) voltage independent of variations of peripheral factors, such as input supply voltage, load current, and temperature. A typical voltage regulator reduces variations of the output voltage to a range much smaller than those of input supply voltage, thereby minimizing variations of total bias current against bias voltage.

It is well known that an unregulated voltage provided by a conventional voltage regulator is not sufficient for applying to many electronic circuits. The reasons are, for example, that the unregulated output voltage is not constant as load current varies, that the unregulated output voltage varies with variations of the input supply voltage, and that the unregulated output voltage varies with variations of temperature because semiconductor devices used in electronic circuits are affected by temperature.

Accordingly, an output voltage of a voltage regulator is required to remain as constant as possible under the changes of external factors, such as input supply voltage, load current, and temperature.

Examples of contemporary voltage regulators are disclosed, for example, in U.S. Pat. No. 5,453,678 for Programmable Output Voltage Regulator issued to Bertolini et al., U.S. Pat. No. 5,467,010 for Voltage Regulator Control Circuit issued to Quarmby et al., U.S. Pat. No. 5,648,718 for Voltage Regulator With Load Pole Stabilization issued to Edwards, U.S. Pat. No. 5,672,959 for Low Drop-Out Voltage Regulator Having High Ripple Rejection And Low Power Consumption issued to Der, U.S. Pat. No. 5,717,319 for Method And Reduce The Power Consumption Of An Electronic Device Comprising A voltage Regulator issued to Jokinen, U.S. Pat. No. 5,825,169 for Dynamically Biased Current Gain Voltage Regulator With Low Quiescent Power Consumption issued to Selander et al., U.S. Pat. No. 5,852,359 for Voltage Regulator With Load Pole Stabilization issued to Callahan, Jr. et al., and U.S. Pat. No. 5,864,226 for Low Voltage Regulator Having Power Down Switch issued to Wang et al., whose disclosures are herein incorporated by reference.

SUMMARY OF THE INVENTION

An object of the present invention is to provide a programmable voltage regulator circuit for regulating its output voltage selectively with respect to more than one voltage.

It is another object of the present invention to provide a voltage regulator circuit with a power saving feature.

It is yet another object of the present invention to provide a voltage regulator circuit with low output impedance.

It is yet another object of the present invention to provide a voltage regulator circuit having a structure suitable for integration.

The present invention encompasses a voltage regulator for generating a regulated output voltage within a predetermined scope by using a power supply voltage. In brief, a voltage regulator of the present invention comprises a programmable reference generator, a programmable output adjustor, an error amplifier, and an output driver. The programmable reference generator is responsive to a first programming signal applied externally and generates a reference voltage corresponding to the first programming signal by using the power supply voltage. The programmable output adjustor is responsive to a second programming signal applied externally and generates an output adjust voltage corresponding to the second programming signal by using the regulated output voltage. The error amplifier generates an error voltage corresponding to a difference between the reference voltage and the output adjust voltage. The output driver drives the regulated output voltage in response to the error voltage.

According to a preferred aspect of the invention, the programmable reference generator, the programmable output adjustor and the error amplifier each is disabled in response to a power saving control signal applied externally. The output driver is also disabled in response to an output enable control signal applied externally. The programmable reference generator, the programmable output adjustor, the error amplifier, and the output driver do not consume power when they are disabled. In an embodiment, the programmable reference generator, the programmable output adjustor, the error amplifier and the output driver may preferably be integrated into a single semiconductor chip.

The programmable reference generator of the invention includes a variable resistance circuit for providing a variable resistance in response to the first programming signal, and a bandgap reference circuit for generating the reference voltage based on the variable resistance. The first and second programming signals may preferably be digital signals. The variable resistance circuit includes a decoder for providing a plurality of first decoding signals by decoding the first programming signal, a resistor array having a plurality of serially-connected resistors, and a switch circuit for varying resistance of the resistor array in response to the first decoding signals. The bandgap reference circuit includes a bias voltage generator for generating a bias voltage. The error amplifier is biased by the bias voltage. The bias voltage generator includes a cascode current source having a plurality of current mirrors serially connected between the power supply voltage and the variable resistance circuit. The cascode current source is disabled in response to the power saving control signal.

The programmable output adjustor includes a decoder for providing a plurality of second decoding signals by decoding the second programming signal, and an adjust voltage generator for varying the output adjust voltage in response to the second decoding signals. The adjust voltage generator includes a variable voltage divider responsive to the second decoding signals. The variable voltage divider includes a capacitor array having a plurality of capacitors, and switch circuits for varying capacitance of the capacitor array in response to the second decoding signals.

According to another aspect of the invention, the programmable reference generator, the programmable output adjustor, and the error amplifier each is switched on and off in response to a power saving control pulse signal. The output driver is also switched on and off in response to an output enable control pulse signal. The programmable output adjustor, the error amplifier, and the output driver do not consume power when off. Each of the power saving control pulse signal and the output enable control pulse signal has a variable duty cycle. The duty cycle of the output enable control pulse signal varies relative to the duty cycle of the power saving control pulse signal.

According to still another preferred aspect of the invention, the voltage regulator includes a standalone type capacitor that is coupled between the regulated output voltage and a ground voltage. An appropriate capacitance value of the standalone type capacitor is preferably determined by a load coupled to the regulated output voltage.

BRIEF DESCRIPTION OF THE DRAWINGS

The above and various other features and advantages of the present invention will be readily understood with reference to the following detailed description taken in conjunction with accompanying drawings, in which like reference numerals designate like structural elements, and, in which.

DETAILED DESCRIPTION OF PREFERRED EMBODIMENTS

The present invention will now be described more fully hereinafter with reference to the accompanying drawings in which preferred embodiments of the invention are shown. This invention may, however, be embodied in many different forms and should not be construed as limited to the embodiments set forth herein; rather, these embodiments are provided in such particularity as to enable those skilled in the art to make and use the invention without involving extensive experimentation. Like numbers refer to like elements throughout and signal lines and signals thereon are referred to by the same reference symbols.

Figure 1:
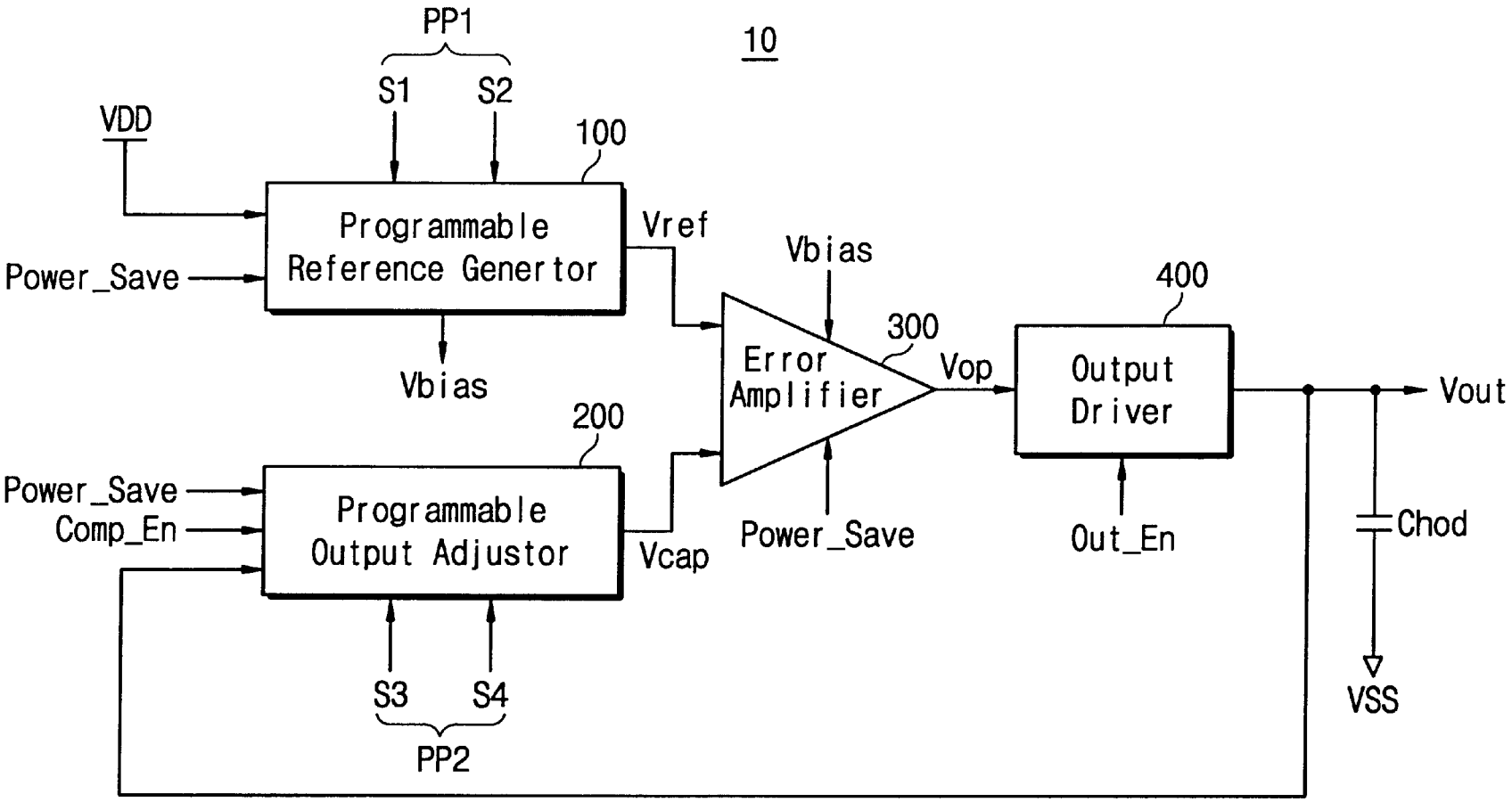
FIG. 1 is a block diagram illustrating a preferred embodiment of a programmable voltage regulator circuit according to the present invention.

FIG. 1 illustrates a preferred embodiment of a programmable voltage regulator circuit according to the present invention for regulating output voltage selectively with respect to more than one voltage. Referring to FIG. 1, the voltage regulator 10 generates a regulated output voltage Vout within a predetermined scope (e.g., 0.5–5.9 volts) by using a power supply voltage VDD (e.g., 2–6 volts). The voltage regulator 10 includes a programmable reference generator 100, a programmable output adjustor 200, an error amplifier 300, an output driver 400, and a capacitor Chod for eliminating ripples on the output voltage. The programmable reference generator 100 is responsive to a first programming signal PP1 applied externally and generates a reference voltage Vref (e.g., 1.0–1.5 volts) corresponding to the first programming signal PP1 by using the power supply voltage. In addition, the programmable reference generator 100 generates a bias voltage Vbias to the error amplifier 300. The programmable output adjustor 200 is responsive to a second programming signal PP2 applied externally and generates an output adjust voltage Vcap in response to the second programming signal PP2 and the regulated output voltage Vout which is fed back to the programmable output adjustor 200 from the output driver 400. Each of the first and second programming signals PP1 and PP2 is preferably a digital signal of at least 2 bits (e.g., S1 and S2, or S3 and S4).

The error amplifier 300 generates an error voltage Vop corresponding to a difference between the reference voltage Vref and the output adjust voltage Vcap. The output driver 400 drives the regulated output voltage Vout in response to the error voltage Vop. The capacitor coupled between the output voltage Vout and a ground voltage VSS is preferably of a standalone type and its capacitance may range from 0.05 to 1.00 microfarads.

In an embodiment of the invention, the programmable reference generator 100, the programmable output adjustor 200 and the error amplifier 300 each receives a power saving control signal Power_Save applied externally and is switched on and off in response to the power saving control signal Power_Save. The output driver 400 is also switched on and off in response to an output enable control signal Out_EN applied externally. The programmable reference generator 100, the programmable output adjustor 200, the error amplifier 300, and the output driver 400 do not consume power when they are switched off. Preferably, the power saving control signal Power_Save and the output enable control signal Out_En are pulse signals and have variable duty cycles. A duty cycle of the output enable control pulse signal Out_En varies relative to a duty cycle of the power saving control pulse signal Power_Save (this will be described in detail below referring to FIG. 5).

The programmable reference generator 100, the programmable output adjustor 200 and the error amplifier 300 each may be disabled in response to the power saving control signal Power_Save. The output driver 400 may also be disabled in response to the output enable control signal Out_En. The programmable reference generator 100, the programmable output adjustor 200, the error amplifier 300, and the output driver 400 do not consume power when disabled.

The programmable reference generator 100, the programmable output adjustor 200, the error amplifier 300 and the output driver 400 may preferably be integrated into a single semiconductor chip.

Figure 2:
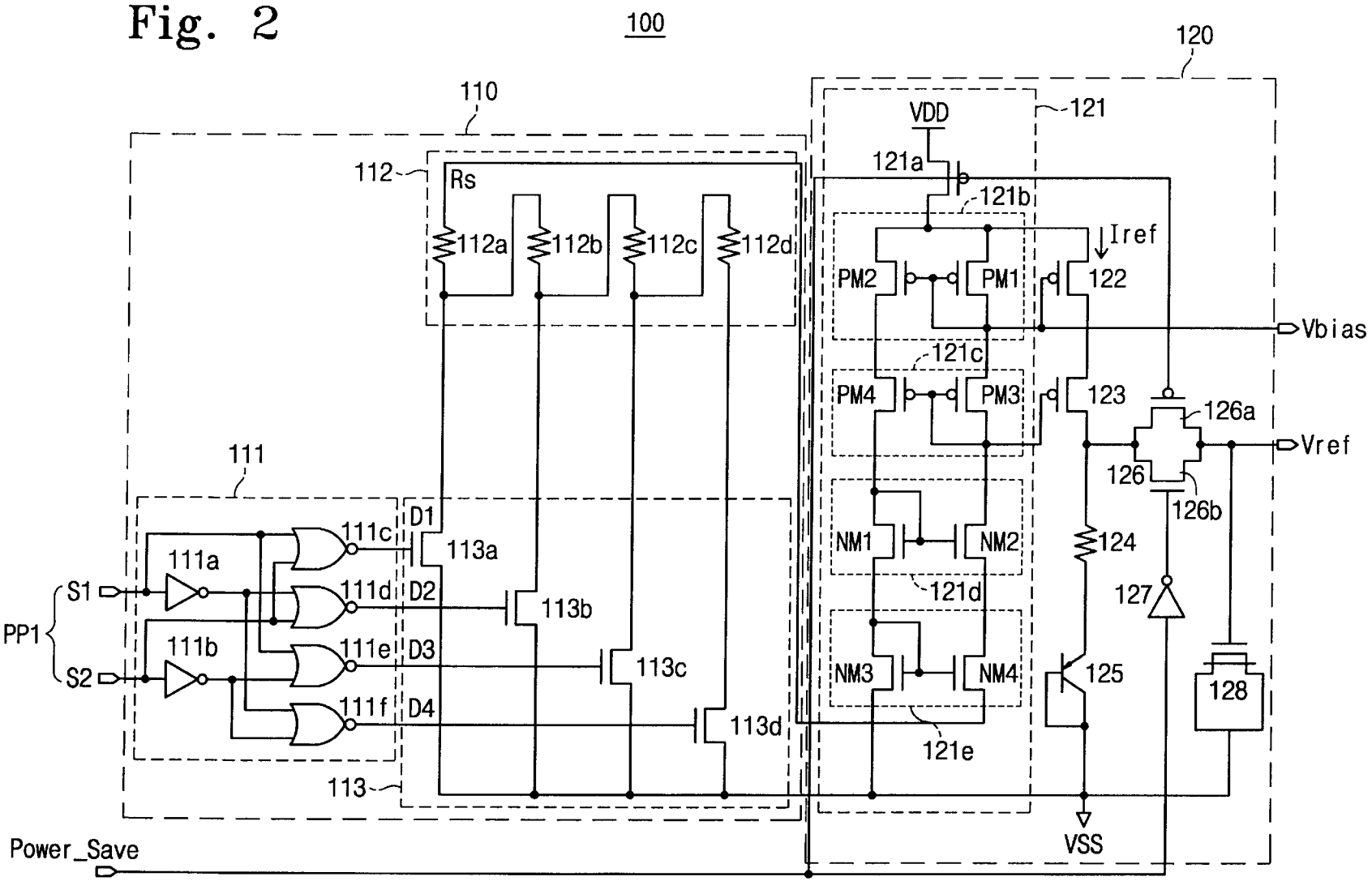
FIG. 2 is a circuit diagram of an embodiment of the programmable reference generator illustrated in FIG. 1.

FIG. 2 is a detailed circuit diagram of the programmable reference generator 100 of FIG. 1 according to an embodiment of the present invention. Referring to FIG. 2, the programming reference generator 100 comprises a variable resistance circuit 110 and a bandgap reference circuit 120. The variable resistance circuit 110 varies its resistance in response to the first programming signal PP1. The bandgap reference circuit 120 generates the bias voltage Vbias and the reference voltage Vref based on the resistance of the variable resistance circuit 110.

The variable resistance circuit 110 provides a resistance determined by the two-bit programming signal PP1, i.e., the values of signals S1 and S2. The variable resistance circuit 110 includes a decoder 111, a resistor array 112 having a plurality of serially-connected resistors 112*a*–112*d*, and a switch circuit 113 coupled between the decoder 111 and the resistor array 112. The serially-connected resistors 112*a*–112*d* are coupled between the switch circuit 113 and the bandgap reference circuit 120.

The decoder 111 includes two inverter gates 111*a* and 111*b*, and four NOR gates 111*c*–111*f*, and provides four decoding signals D1–D4 by decoding the first programming signal PP1 (i.e., S1 and S2). Inputs of the inverter gates 111*a* and 111*b* receive the low-bit signal S1 and the high-bit signal S2 of the programming signal PP1, respectively. Two inputs of the NOR gate 111*c* receive the signals S1 and S2, respectively. One input of the NOR gate 111*d* is coupled to an output of the inverter gate 111*a* and the other input thereof receives the signal S2. NOR gate 111*e* has one input to receive the signal S1 and the other input coupled to an output of the inverter gate 111*b*. Two inputs of the NOR gate 111*f* are coupled to the outputs of the inverter gates 111*a* and 111*b*, respectively.

One of the decoding signals D1–D4 goes high in response to the value of the programming signal PP1. For example, when the logic value of the high and low bits S2 and S1 of the programming signal PP1 is "00", the decoding signal D1 goes high; when "01", the signal D2 goes high; when "10", the signal D3 goes high; and when "11", the signal D4 goes high.

The switch circuit 113 includes four NMOS transistors 113*a*–113*d* and varies the resistance of the resistor array 112 in response to the decoding signals D1–D4. Transistor 113*a* has a drain-source conduction path coupled between the junction of resistors 112*a*, 112*b* and a ground voltage terminal VSS, and a gate coupled to the output D1 of the NOR gate 111*c*. Transistor 113*b* has a drain-source conduction path coupled between the junction of resistors 112*b*, 112*c* and the ground voltage terminal VSS, and a gate coupled to the output D2 of the NOR gate 111*d*. Transistor 113*c* has a drain-source conduction path coupled between the junction of resistors 112*c*, 112*d* and the ground voltage terminal VSS, and a gate coupled to the output D3 of the NOR gate 111*e*. Transistor 113*d* has a drain-source conduction path coupled between the resistor 112*d* and the ground voltage terminal VSS, and a gate coupled to the output D4 of the NOR gate 111*f*.

When the value of the high and low bits S2 and S1 of the programming signal PP1 is "00", transistor 113*a* turns on; when "01", transistor 113*b* turns on; when "10", transistor 113*c* turns on; and when "11", transistor 113*d* turns on. These on/off states of the transistors 113*a*–113*d* vary the resistance Rs of the resistor array 112. The resistor array 112 has the largest resistance when the value of the S2 and S1 bits is "11", and has the smallest resistance when the value of the S2 and S1 bits is "00". These variations of the resistance Rs cause the variations in the bias voltage Vbias and the reference voltage Vref.

The bandgap reference circuit 120 includes a bias voltage generator 121 which includes a cascode current source having, for example, four stacked current mirrors 121*b*–121*e*. The bias voltage generator 121 generates the bias voltage Vbias. The bias voltage generator 121 comprises five transistors 121*a* and PM1–PM4 of a first type (i.e., PMOS transistors) and four transistors NM1–NM4 of a second type (i.e., NMOS transistors). Transistor 121*a* includes a source-drain conduction path of which a first end (i.e., source electrode) is coupled to the power supply voltage terminal VDD, and a control electrode (i.e., gate electrode) coupled to the power saving control signal Power_Save. Transistor PM1 has a conduction path of which a first end is coupled to a second end (i.e., drain electrode) of the transistor 121*a*'s conduction path and a second end is coupled to the bias voltage output terminal Vbias. A control electrode of the transistor PM1 is coupled to the bias voltage output terminal Vbias. A first end of transistor PM2's conduction path is coupled to the second end of the transistor 121*a*'s conduction path, and a control electrode thereof is coupled to the bias voltage output terminal Vbias. The fourth transistor PM3 has a conduction path with a first end coupled to the bias voltage output terminal Vbias and a second end coupled to its own control electrode. Transistor PM4 includes a conduction path with a first end coupled to a second end of the transistor PM2's conduction path and a control electrode coupled to the second end of the transistor MP3's conduction path.

Transistor NM1 includes a conduction path having a first end (i.e., drain electrode) coupled to a second end (i.e., drain electrode) of the transistor PM4's conduction path and a second end coupled to its own control electrode. Transistor NM2 includes a conduction path having a first end coupled to the second end of the transistor PM3's conduction path, and a control electrode coupled to the second end of the transistor PM4's conduction path. Transistor NM3 includes a conduction path having a first end coupled to a second end of the transistor NM1's conduction path and a second end coupled to the ground voltage terminal VSS, and a control electrode coupled to a second end of the transistor NM1's conduction path. Transistor NM4 includes a conduction path having a first end coupled to a second end of the transistor NM2's conduction path and a second end coupled to the resistor 112*a* in the variable resistance circuit 112, and a control electrode coupled to the second end of the transistor NM1's conduction path.

The bias voltage generator 121 is disabled in response to the power saving control signal Power_Save. That is, the bias voltage generator 121 does not consume power when the first transistor 121*a* is turned off by the power saving control signal Power_Save.

The bandgap reference circuit 120 further includes two PMOS transistors 122 and 123, a PNP bipolar transistor 125 (a third type transistor), a resistor 124, a CMOS transmission gate 126, an inverter gate 127, and a MOS capacitor 128. The transmission gate 126, the inverter gate 127 and the capacitor 128 are provided for holding the reference voltage Vref during a power saving mode.

Transistor 122 has a conduction path with a first end coupled to the second end of the transistor 121*a*'s conduction path, and a control electrode coupled to the bias voltage output terminal Vbias. Transistor 123 has a conduction path with a first end coupled to a second end of the transistor 122's conduction path, and a control electrode coupled to the second end of the transistor PM3 conduction path. The resistor 124 has a first end coupled to a second end of the transistor 123's conduction path. Transistor 125 includes a emitter-collector conduction path having a first end (i.e., emitter electrode) coupled to a second end of the resistor 124 and a second end (i.e., collector electrode) coupled to the ground voltage terminal VSS, and a control electrode (i.e., base electrode) coupled to the ground voltage. The CMOS transmission gate 126 comprising a PMOS transistor 126*a* and an NMOS transistor 126*b* has a conduction path coupled between the second end of the transistor 123's conduction path and the reference voltage output terminal Vref. A first control electrode of the transmission gate 126 is coupled to the power saving control signal Power_Save, and a second control electrode thereof is coupled through the inverter gate 127 to the power saving control signal Power_Save. The MOS capacitor 128 has a first end coupled to the reference voltage output terminal Vref and a second end coupled to the ground voltage terminal VSS.

Figure 5:
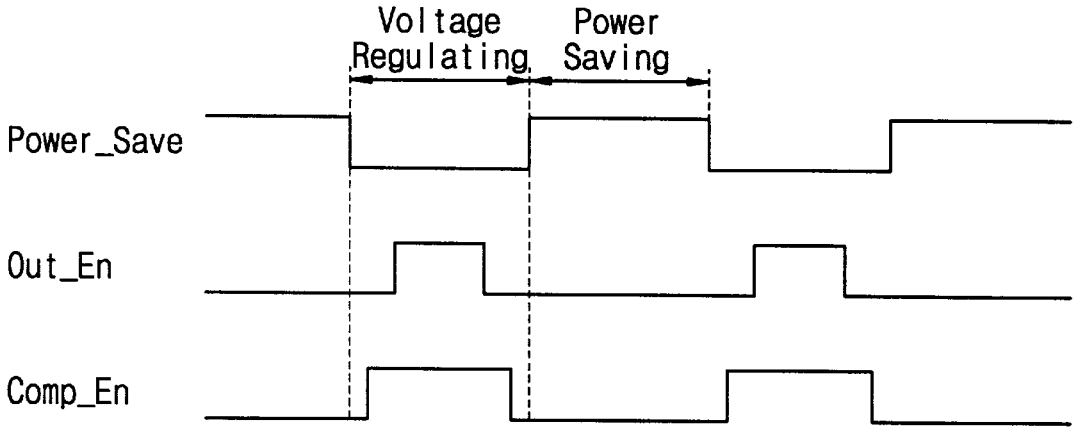
FIG. 5 is a timing diagram of the external control signals applied to the circuit in FIG. 1.

The bias voltage Vbias is proportional to the resistance Rs of the resistor array 112, but the reference voltage Vref is inversely proportional to the resistance Rs of the resistor array 112. The reference voltage Vref is the sum of $V_{124}$ and $V_{BE}$, where $V_{124}$ is the drop voltage across the resistor 124 and $V_{BE}$ is the base-emitter voltage of the bipolar transistor 125. When the power saving control signal Power_Save is low, the transmission gate 126 is switched on. Conversely, when the signal Power_Save is high, the gate 126 is switched off. The duty cycle of the power saving control pulse signal Power_Save can be variable, and it varies according to a load coupled to the voltage regulator of the invention. For example, the pulse signal Power_Save may have a duty cycle ranging from 30 through 80%. With continuing reference to FIG. 5, the programmable reference generator 100 does not consume power while the power saving control pulse signal is active (i.e., high).

Figure 3:
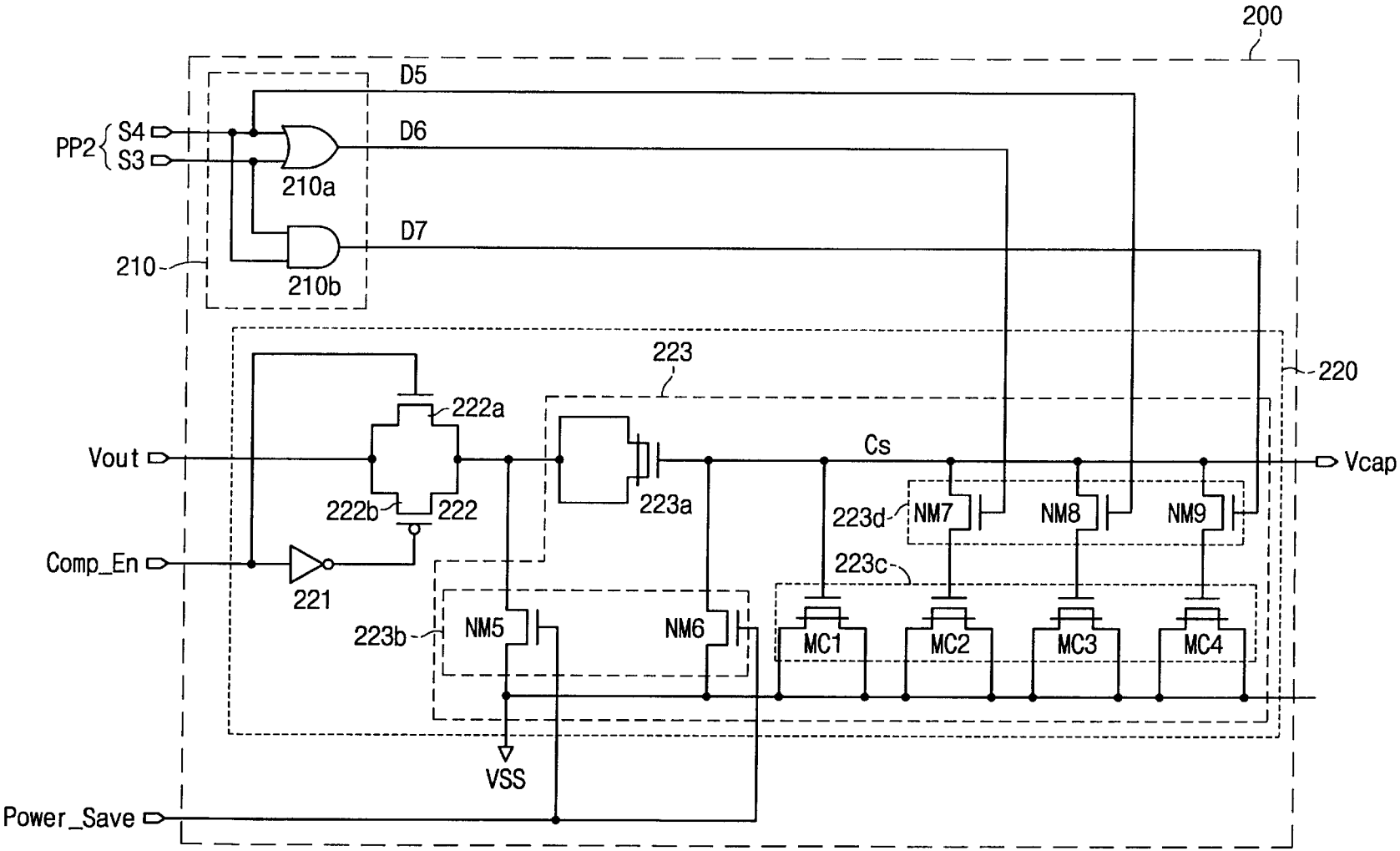
FIG. 3 is a circuit diagram of an embodiment of the programmable output adjustor illustrated in FIG. 1.

FIG. 3 illustrates a detailed circuit configuration of the programmable output adjustor 200. Referring to FIG. 3, the programmable output adjustor 200 comprises a decoder 210 that provides three decoding signals D5-D7 by decoding the second programming signal PP2 of two bits S3 and S4. The programming output adjustor 200 further includes an adjust voltage generator 220 that varies the output adjust voltage Vcap in response to the decoding signals D5-D7 among which the signal D5 has the same phase as the low-bit signal S3 of the programming signal PP2.

Decoder 210 includes an OR gate 210*a* and an AND gate 210*b*. The OR gate 210*a* has inputs receiving the signals S3 and S4, respectively, and an output generating a decoding signal D6. Similarly, the AND gate 210*b* has inputs receiving the signals S3 and S4, respectively, and an output generating a decoding signal D7.

The adjust voltage generator 220 includes an inverter gate 221, a CMOS transmission gate 222, and a variable voltage divider 223. The transmission gate 222 comprising an NMOS transistor 222*a* and a PMOS transistor 222*b* has a conduction path coupled between the voltage output terminal Vout and the variable voltage divider 223. A first control electrode of the transmission gate 222 receives a transmission control signal Comp_En applied externally. The control signal Comp_En is also applied to a second control electrode of the transmission gate 222 via the inverter gate 221. The transmission gate 222 is switched on when the transmission control signal Comp_En is high, so that the output voltage Vout can be applied to the variable voltage divider 223. The transmission gate 222 is off when the control signal Comp_En is low, so that the Vout cannot be applied to the variable voltage divider 223. As may be seen in FIG. 5, the signal Comp_En is activated while the power saving control pulse signal Power_Save remains inactive. The duty cycle of the transmission control signal Comp_En is variable relative to the duty cycle of the power saving control pulse signal Power_Save.

Referring again to FIG. 3, the variable voltage divider 223 generates the output adjust voltage Vcap in response to the decoding signals D5–D7. The variable voltage divider 223 comprises a MOS coupling capacitor 223*a* coupled between the transmission gate 222 and the output adjust voltage terminal Vcap and a switch circuit 223*b*. The switch circuit 223*b* has two NMOS transistors NM5 and NM6. A conduction path (i.e., drain-source channel) of the transistor NM5 is coupled between an electrode of the capacitor 223*a* and the ground voltage terminal VSS, and a control electrode thereof receives the power saving control signal Power_Save. The transistor NM6 has a conduction path coupled between the other electrode of the capacitor 223*a* and the ground voltage terminal VSS, and a control electrode coupled to the power saving control signal Power_Save. The switch circuit 223*b* sets the voltage across the capacitor 223*a* to the ground voltage VSS while the power saving control signal Power_Save remains at a high level.

The variable voltage divider 223 further includes a capacitor array 223*c* having four MOS capacitors MC1–MC4 arranged in parallel between the output adjust voltage terminal Vcap and the ground voltage terminal Vss, and another switch circuit 223*d*. The capacitor MC1 in the capacitor array 223*c* is directly coupled to the output adjust voltage terminal Vcap, but the other capacitors MC2–MC4 therein are coupled via the switch circuit 223*d* to the terminal Vcap. The switch circuit 223*d* has three NMOS transistors NM7–NM9. The transistor NM7 has a conduction path coupled between the output adjust voltage terminal Vcap and the capacitor MC2, and a control electrode coupled to the output D6 of the OR gate 210*a* of the decoder 210. The transistor NM8 has a conduction path coupled between the terminal Vcap and the capacitor MC3, and a control electrode coupled to the output D5 of the decoder 210 (or high bit signal S4 of the programming signal PP2). The transistor NM9 has a conduction path coupled between the terminal Vcap and the capacitor MC4, and a control electrode coupled to the output D7 of the AND gate 210*b*.

In an alternative embodiment, the capacitor array 233*c* may be replaced with a resistor array having a plurality of resistors coupled in the same way as the capacitor array 233*c*. However, the capacitor array 233*c* is preferred to the resistor array because the capacitor array 223*c* does not provide any direct current (DC) path between the output adjust voltage terminal Vcap and the ground voltage terminal VSS, so that the power consumption of the capacitor array 223*c* is lower than that of the resistor array having DC paths inevitably.

Referring to FIG. 3 again, all the capacitors 223*a*, MC1–MC4 may preferably have same capacitance. In alternative embodiments, however, their capacitance may be different from each other. Here, it is assumed for convenience of explanation that the capacitors 223*a*, MC1–MC4 all are identical and that each of the capacitors 223*a*, MC1–MC4 has a unit capacitance $C_{unit}$. Then, the output adjust voltage Vcap is given as follows:

$$Vcap=Vout\times C_{223a}/(C_{223a}+Cs)$$

where "$C_{223a}$" and "Cs" denote the capacitance of the capacitor 223*a* and the total capacitance of the capacitor array 223*c*, respectively.

When the value of the high and low bits S4 and S3 of the programming signal PP2 is "00", the transistors NM7–NM9 in the switch circuit 223*d* turn off; when "01", only the transistor NM7 turns on; when "10", the transistors NM7 and NM8 turn on; and when "11", all the transistors NM7–NM9 turn on. These on/off states of the transistors NM7–NM9 vary the total capacitance Cs of the capacitor array 223*c*. The total capacitance Cs of the capacitor array 223*c* becomes the largest when the value of the S4 and S3 bits is "11", and becomes the smallest when the value of the bits S4 and S3 is "00". These variations of the capacitance Cs result in the variations in the output adjust voltage Vcap. For example, if the value of S4 and S3 is "01" and the output voltage Vout is 1 volt, then $Cs=2C_{unit}$ and Vcap=0.33 volts. And, if the value of S4 and S3 is "10" and the Vout is 1 volt, then the Vcap=0.50 volts since $Cs=C_{unit}$.

Figure 4:
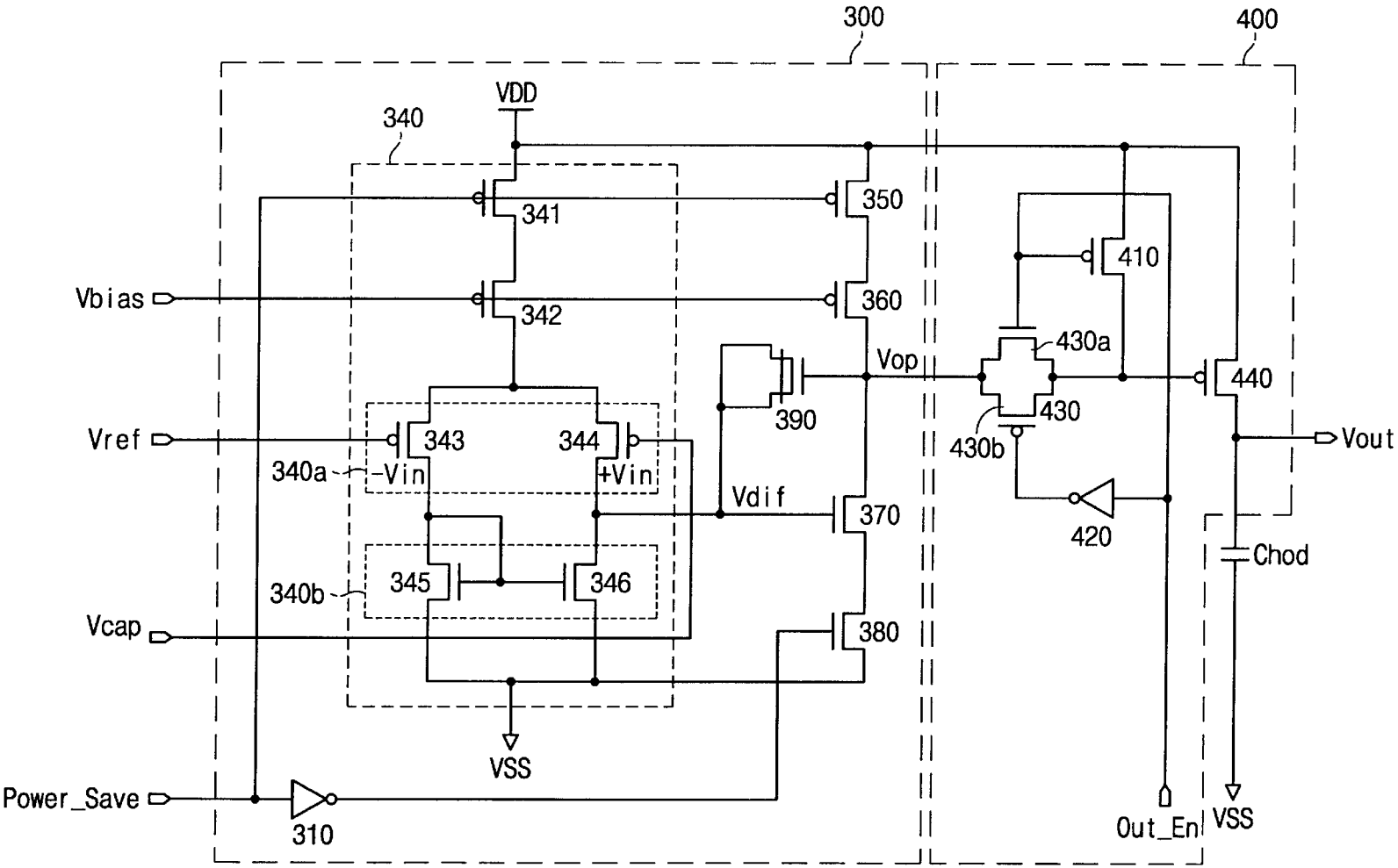
FIG. 4 is a circuit diagram of embodiments of the error amplifier and the output driver illustrated in FIG. 1.

FIG. 4 illustrates preferred embodiments of the error amplifier 300 and the output driver 400. Referring to FIG. 4, the error amplifier 300 includes an inverter gate 310, a differential amplifier 340, two PMOS transistors 350 and 360, two NMOS transistors 370 and 380, and a MOS phase margin compensation capacitor 390 for preventing oscillation of the differential amplifier 340 owing to the positive feedback. The inverter gate 310 has its input receiving the power saving control signal Power_Save. The differential amplifier 340 includes a PMOS switching transistor 341, a PMOS current source transistor 342, a differential pair 340*a* comprising PMOS transistors 343 and 344, and a current mirror 340*b* comprising NMOS transistors 345 and 346.

The conduction paths of the transistors 341 and 342 are coupled in series between the power supply voltage terminal VDD and the differential pair 340*a,* and control electrodes (i.e., gate electrodes) of the transistors 341 and 342 are coupled to the power saving control signal Power_Save applied externally and the bias voltage Vbias from the programmable reference generator 100, respectively. Control electrodes of the transistors 343 and 344 (i.e., inverting input and non-inverting input of the differential pair 340*a*) are applied with the reference voltage Vref from the programmable reference generator 100 and the output adjust voltage Vcap from the programmable output adjustor 200, respectively. The conduction path of the transistor 343 is coupled via the conduction path of the transistor 345 of the current mirror 340*b* to the ground voltage terminal VSS, and similarly the conduction path of the transistor 344 is serially coupled via the conduction path of the transistor 346 to the ground voltage terminal VSS.

Control electrodes of the transistors 345 and 346 are coupled to a drain junction of the transistors 343 and 345. Conduction paths of the transistors 350, 360, 370 and 380 are coupled in series between the power supply voltage terminal VDD and the ground voltage terminal VSS. The control electrodes of the transistors 350 and 360 are coupled to the power saving control signal Power_Save and the bias voltage Vbias, respectively. A control electrode of the transistor 370 is supplied with an amplifier output voltage Vdif from a drain junction of the transistors 344 and 346 (i.e., an output of the differential amplifier 340). A control electrode of the transistor 380 is coupled to an output of the inverter gate 310. One electrode of the MOS transistor 390 is coupled to the control electrode of the transistor 370 and the other electrode of the MOS transistor 390 is coupled to a drain junction of the transistors 360 and 370. The error voltage Vop, representing a difference between the reference voltage Vref and the output adjust voltage Vcap, appears on the drain junction of the transistors 360 and 370 (i.e., an output of the error amplifier 300).

The error voltage Vop increases when the output adjust voltage Vcap is greater than the reference voltage Vref. Conversely, the error voltage Vop decreases when the output adjust voltage Vcap is less than the reference voltage Vref. The transistors 341 and 350 are switched on when the power saving control signal Power_Save remains inactive (i.e., low), and they are off when the control signal Power_Save is active (i.e., high) so that the error amplifier 300 does not consume power.

The output driver 400 includes a PMOS switching transistor 410, an inverter gate 420, a transmission gate 430, and a PMOS drive transistor 440. The transistor 410 has a control electrode receiving the output enable control signal Out_En that is provided externally. The transmission gate 430, comprising an NMOS transistor 430*a* and a PMOS transistor 430*b,* has a conduction path coupled between the output Vop of the error amplifier 300 and a control electrode of the transistor 440. A first control electrode of the transmission gate 430 receives the output enable control signal Out_En which is also applied to a second control electrode of the transmission gate 430 via the inverter gate 420. The transistor 410 turns off when the output enable control signal Out_En is high and turns on when the signal Out_En is low. The transmission gate 430 is switched on when the output enable control signal Out_En is high, and the gate 430 is off when the signal Out En is low.

Referring to FIG. 5, the output enable control signal Out_En is activated while the power saving control pulse signal Power_Save remains inactive. The output enable control signal Out_En has a variable duty cycle which varies relative to the duty cycles of the power saving control pulse signal Power_Save and the transmission control signal Comp_En. Referring to FIG. 4 again, the drive transistor 440 has a conduction path coupled between the power supply terminal VDD and the output voltage terminal Vout and turns off when the output enable control signal Out_En is inactive (low).

As described above, the voltage regulator 10 of the invention is preferably provided with a standalone type capacitor Chod that is coupled between the output voltage terminal Vout and the ground voltage terminal VSS in order to eliminate ripple components on the output voltage Vout. An appropriate capacitance value of the standalone type capacitor Chod may preferably be determined by a load coupled to the regulated output voltage terminal Vout.

In the event the regulated output voltage Vout is lower than a predetermined voltage value, the output adjust voltage Vcap will be lower than the reference voltage Vref, thereby yielding a relatively low error voltage Vop so that a relatively large amount of current will flow through the transistor 440. Conversely, if the output voltage Vout is higher than the predetermined voltage value, the output adjust voltage Vcap will be higher than the reference voltage Vref, thereby yielding a relatively high error voltage Vop so that a relatively small amount of current will flow through the transistor 440.

If the current $I_{440}$ flowing through the transistor 440 is larger than the load current $I_{LOAD}$ flowing through the output terminal Vout to a load coupled to the output terminal Vout, then the capacitor Chod will be charged until the output adjust voltage Vcap equals the reference voltage Vref. The charged voltage of the capacitor Chod will be held until the output adjust voltage Vcap becomes smaller than the reference voltage Vref. But, if the current $I_{440}$ is smaller than the current $I_{LOAD}$ the capacitor Chod will be discharged, causing the capacitor voltage to decrease. As a result, the output adjust voltage Vcap will be lower than the reference voltage Vref so that the capacitor Chod will be charged again. These repetitive charging and discharging of the capacitor Chod provides a constant voltage, i.e. a regulated voltage Vout.

The above described voltage regulator of the present invention may be adopted, for example, for liquid crystal display devices of electronic calculators.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A voltage regulator for generating a regulated output voltage by using a power supply voltage, comprising:

a programmable reference generator responsive to a first programming signal applied externally, for generating a reference voltage corresponding to the first programming signal by using the power supply voltage;

a programmable output adjustor responsive to a second programming signal applied externally, for generating an output adjust voltage corresponding to the second programming signal by using the regulated output voltage;

an error amplifier for generating an error voltage corresponding to a difference between the reference voltage and the output adjust voltage; and an output driver for driving the regulated output voltage in response to the error voltage.

2. The voltage regulator according to claim 1, further comprises a capacitor coupled between the regulated output voltage and a ground voltage.

3. The voltage regulator according to claim 1, wherein the programmable reference generator, the programmable output adjustor and the error amplifier are selectively disabled in response to a power saving control signal applied externally.

4. The voltage regulator according to claim 1, wherein the output driver is disabled in response to an output enable control signal applied externally.

5. The voltage regulator according to claim 1, wherein the programmable reference generator, the programmable output adjustor, the error amplifier and the output driver are integrated into a single semiconductor chip.

6. The voltage regulator according to claim 5, further comprises a capacitor coupled between the regulated output voltage and a ground voltage, wherein the capacitor is of a standalone type.

7. A voltage regulator for generating a regulated output voltage by using a power supply voltage, comprising:

a programmable reference generator responsive to a first programming signal applied externally, for generating a reference voltage corresponding to the first programming signal by using the power supply voltage;

a programmable output adjustor responsive to a second programming signal applied externally, for generating an output adjust voltage corresponding to the second programming signal by using the regulated output voltage;

an error amplifier for generating an error voltage corresponding to a difference between the reference voltage and the output adjust voltage; and an output driver for driving the regulated output voltage in response to the error voltage;

wherein the programmable reference generator includes a variable resistance circuit for providing a variable resistance in response to the first programming signal, and a bandgap reference circuit for generating the reference voltage based on the variable resistance.

8. The voltage regulator according to claim 7, wherein the variable resistance circuit includes:

a decoder for providing a plurality of decoding signals by decoding the first programming signal;

a resistor array having a plurality of serially-connected resistors; and a control circuit for varying resistance of the resistor array in response to the decoding signals.

9. The voltage regulator according to claim 7, wherein the bandgap reference circuit includes a bias voltage generator for generating a bias voltage varying in response to the variable resistance.

10. The voltage regulator according to claim 9, wherein the error amplifier is biased by the bias voltage.

11. The voltage regulator according to claim 9, wherein the bias voltage generator includes a cascode current source.

12. The voltage regulator according to claim 11, wherein the cascode current source includes a plurality of current mirrors serially connected between the power supply voltage and the variable resistance circuit.

13. The voltage regulator according to claim 12, wherein the cascode current source is disabled in response to a power saving control signal applied externally.

14. The voltage regulator according to claim 13, wherein the cascode current source comprises;

a first transistor having a control electrode coupled to the power saving control signal and a conduction path of which a first end is coupled to the power supply voltage;

a second transistor having a control electrode coupled to the bias voltage and a conduction path of which a first end is coupled to a second end of the first transistor conduction path and a second end is coupled to the bias voltage;

a third transistor having a control electrode coupled to the bias voltage and a conduction path of which a first end is coupled to the second end of the first transistor conduction path;

a fourth transistor having a conduction path of which a first end is coupled to the bias voltage and a second end is coupled to a control electrode of the fourth transistor;

a fifth transistor having a control electrode coupled to the second end of the fourth transistor conduction path and a conduction path of which a first end is coupled to a second end of the third transistor conduction path;

a sixth transistor having a conduction path of which a first end is coupled to a second end of the fifth transistor conduction path and a control electrode of the sixth transistor;

a seventh transistor having a control electrode coupled to the second end of the fifth transistor conduction path and a conduction path of which a first end is coupled to the second end of the fourth transistor conduction path;

an eighth transistor having a control electrode coupled to a second end of the sixth transistor conduction path and a conduction path of which a first end is coupled to the second end of the sixth transistor conduction path and a second end is coupled to a ground voltage; and a ninth transistor having a control electrode coupled to the second end of the sixth transistor conduction path and a conduction path of which a first end is coupled to a second end of the seventh transistor conduction path and a second end coupled to the variable resistance circuit.

15. The voltage regulator according to claim 14, wherein the first, second, third, fourth, and fifth transistors are first type transistors, and the sixth, seventh, eighth and ninth transistors are second type transistors.

16. The voltage regulator according to claim 14, wherein the bandgap reference circuit comprises:

a tenth transistor having a control electrode coupled to the bias voltage and a conduction path of which a first end is coupled to the second end of the first transistor conduction path;

an eleventh transistor having a control electrode coupled to the second end of the fourth transistor conduction path and a conduction path of which a first end is coupled to a second end of the tenth transistor conduction path;

a resistor having a first end coupled to a second end of the eleventh transistor conduction path and a second end;

a twelfth transistor having a control electrode coupled to the ground voltage and a conduction path of which a first end is coupled to the second end of the resistor and a second end is coupled to the ground voltage;

a transmission gate having a conduction path coupled between the second end of the eleventh transistor conduction path and the reference voltage, a first control electrode coupled to the power saving control signal, and a second control electrode coupled through the inverter to the power saving control signal; and a capacitor having a first end coupled to the reference voltage and a second end coupled to the ground voltage.

17. The voltage regulator according to claim 16, wherein the tenth and eleventh transistors are MOS field effect transistors, and the twelfth transistor is bipolar junction transistor.

18. The voltage regulator according to claim 15, wherein the first type transistors and the second type transistors are MOS field effect transistors.

19. The voltage regulator according to claim 7, wherein the programmable output adjustor includes:

a decoder for providing a plurality of decoding signals by decoding the second programming signal; and an adjust voltage generator for varying the output adjust voltage in response to the decoding signals.

20. The voltage regulator according to claim 19, wherein the adjust voltage generator includes a variable voltage divider responsive to the decoding signals.

21. The voltage regulator according to claim 20, wherein the variable voltage divider includes:

a capacitor array having a plurality of capacitors; and a control circuit for varying capacitance of the capacitor array in response to the decoding signals.

22. The voltage regulator according to claim 7, wherein the error amplifier includes a differential amplifier.

23. The voltage regulator according to claim 7, wherein the output driver is disabled in response to an output enable control signal applied externally.

24. The voltage regulator according to claim 23, wherein the output driver comprises:

a first transistor having a conduction path coupled between the power supply voltage and the regulated output voltage, and a control electrode;

a second transistor having a conduction path coupled between the power supply voltage and the control electrode of the first transistor, and a control electrode coupled to the output enable control signal;

an inverter having an anode coupled to the output enable control signal and a cathode; and a transmission gate having a conduction path coupled between the error voltage and the control electrode of the first transistor, a first control electrode coupled to the output enable control signal, and a second control electrode coupled to the cathode of the inverter.

25. A voltage regulator for generating a regulated output voltage by using a power supply voltage, comprising:

a programmable reference generator responsive to a first programming signal applied externally, for generating a reference voltage corresponding to the first programming signal by using the power supply voltage;

a programmable output adjustor responsive to a second programming signal applied externally, for generating an output adjust voltage corresponding to the second programming signal by using the regulated output voltage;

an error amplifier for generating an error voltage corresponding to a difference between the reference voltage and the output adjust voltage; and an output driver for driving the regulated output voltage in response to the error voltage;

wherein the reference generator, the programmable output adjustor and the error amplifier are switched on and off in response to a power saving control pulse signal applied externally.

26. The voltage regulator according to claim 25, wherein the reference generator, the programmable output adjustor, and the error amplifier do not consume power when they turn off.

27. The voltage regulator according to claim 25, wherein the output driver is switched on and off in response to an output enable control pulse signal applied externally.

28. The voltage regulator according to claim 27, wherein a duty cycle of the output enable control pulse signal varies relative to a duty cycle of the power saving control pulse signal.

* * * * *